US005651345A

United States Patent [19]

Miller et al.

[11] Patent Number: 5,651,345

[45] Date of Patent: Jul. 29, 1997

[54] DIRECT OPERATED CHECK HEUI INJECTOR

[75] Inventors: Charles R. Miller, Metamora; Donald J. Waldman, Brimfield; Scott F. Shafer, Morton, all of Ill.

[73] Assignee: Caterpillar Inc., Peoria, Ill.

[21] Appl. No.: 459,269

[22] Filed: Jun. 2, 1995

[51] Int. Cl.[6] ..... F02M 7/00

[52] U.S. Cl. ..... 123/446; 123/496

[58] Field of Search ..... 123/496, 467, 123/498, 446

[56] References Cited

U.S. PATENT DOCUMENTS

| | | | |
|---|---|---|---|
| 3,323,726 | 6/1967 | Heintz | 239/533 |
| 3,753,426 | 8/1973 | Lilley | 123/139 |
| 4,022,166 | 5/1977 | Bart | 123/32 JV |
| 4,360,163 | 11/1982 | Williams | 239/533.5 |
| 4,471,256 | 9/1984 | Igashira et al. | 310/328 |
| 4,584,980 | 4/1986 | Weiger et al. | 123/458 |
| 4,603,671 | 8/1986 | Yoshinaga | 123/446 |
| 4,605,166 | 8/1986 | Kelly | 123/446 |
| 4,628,881 | 12/1986 | Beck | 123/446 |
| 4,640,252 | 2/1987 | Nakamura et al. | 123/446 |
| 4,684,104 | 8/1987 | Micard | 251/129.05 |
| 4,709,679 | 12/1987 | Djordjevic et al. | 123/447 |
| 4,728,074 | 3/1988 | Igashira et al. | 251/57 |
| 4,784,102 | 11/1988 | Igashira et al. | 123/447 |
| 4,821,726 | 4/1989 | Tamura et al. | 123/498 |
| 4,838,233 | 6/1989 | Hayashi et al. | 123/506 |
| 4,911,127 | 3/1990 | Perr | 123/446 |
| 5,004,945 | 4/1991 | Tomita et al. | 310/328 |
| 5,011,082 | 4/1991 | Ausiello et al. | 239/585 |
| 5,053,668 | 10/1991 | Mitsuyasu | 310/317 |
| 5,080,079 | 1/1992 | Yoshida et al. | 123/531 |
| 5,167,370 | 12/1992 | Henkel | 239/533.8 |
| 5,176,120 | 1/1993 | Takahashi | 123/446 |
| 5,186,151 | 2/1993 | Schwerdt et al. | 123/467 |
| 5,191,867 | 3/1993 | Glassey | 123/446 |
| 5,341,783 | 8/1994 | Beck et al. | 123/446 |
| 5,357,933 | 10/1994 | Kasahara et al. | 123/446 |
| 5,370,095 | 12/1994 | Yamaguchi et al. | 123/446 |

FOREIGN PATENT DOCUMENTS

| | | |
|---|---|---|
| 0 199 632 A1 | 10/1986 | European Pat. Off. . |
| 1475338 | 6/1977 | United Kingdom . |
| 1531653 | 11/1978 | United Kingdom . |
| 93/23667 | 11/1993 | WIPO . |

OTHER PUBLICATIONS

SAE Paper 910252, "Development of New Electronically Controlled Fuel Injection System ECD–U2 for Diesel Engines,"Miyaki, Masahiko, et al., Nippondenso Co., Ltd.

Prescher, K., et al., "Common Rail Injection Systems with Characteristics Independent of Engine Speed and with High Injection Pressure—Diesel Engine Potential for the future," except from unknown European publication, presented at the Vienna Motor Symposium, Apr. 1994, pp.54–79, with translation.

Egger, K., et al., "Common Rail Injection System for Diesel Engines—Analysis, Potential, Future," excerpt from unknown European publication, pp. 36–53, presented at the Vienna Motor Symposium, Apr. 1994, with translation.

"Injection Equipment for Diesels of the Future, Bosch displays its more efficient fuel injection technology designs for tomorrow's electronic, low emission engines," *High Speed Diesels & Drives*, pp. 16, 18, (publication date unknown).

*Primary Examiner*—Carl S. Miller

*Attorney, Agent, or Firm*—Marshall, O'Toole, Gerstein, Murray & Borun; William E. McCracken

[57] ABSTRACT

A fuel injection system for diesel engines provides precision metering of the amount of fuel admitted to each cylinder under very high pressure throughout the speed and load range.

22 Claims, 5 Drawing Sheets

DIRECT OPERATED CHECK HEUI INJECTOR

TECHNICAL FIELD

The present invention relates generally to fuel injectors, and more particularly to a HEUI fuel injector having a directly operated check.

BACKGROUND ART

Prior fuel injection systems which may be used with, for example, diesel engines, have typically been of the pump-line-injector type or the unit injector type. A pump-line-injector fuel injection system includes a main pump which pressurizes fuel to a high level, e.g., on the order of 103 to 138 MPa (about 15,000 to 20,000 p.s.i.), and individual fuel injectors which are coupled by fuel supply lines to the pump. In a unit injector system, a low-pressure pump delivers fuel to a plurality of unit injectors, each of which includes means for pressurizing the fuel to a relatively high value, again on the order of 103 to 138 MPa (about 15,000 to 20,000 p.s.i.) or greater.

One type of unit injector system is known as a hydraulically actuated, electronically-controlled unit injector (HEUI) and is disclosed in Glassey U.S. Pat. No. 5,191,867. Actuating fluid in the form of engine oil is pressurized to an intermediate pressure of, for example, 20.7 MPa (3,000 p.s.i.) and is supplied to each unit injector. An engine control module develops injector actuation signals which are supplied to a solenoid winding of each injector. When a solenoid winding is energized by the ECM, a poppet is moved by the solenoid to allow the pressure actuating fluid flow to an intensifier chamber. In response to the admittance of pressurized actuating fluid to such chamber, an intensifier piston is displaced in a direction which pressurizes fuel disposed in a high pressure chamber. The high pressure chamber is in fluid communication with a chamber containing an elongate check which is spring biased against a sealing surface to isolate the check chamber from a combustion chamber of the engine. When the pressure in the check chamber exceeds a valve opening pressure determined by the spring force exerted on the check, the check is lifted, thereby spacing the check tip away from the sealing surfaces and permitting pressurized fuel to escape into the associated engine combustion chamber through one or more injector nozzle orifices. Injection is ended by deenergizing the solenoid winding, thereby causing the poppet to move to a position to isolate the intensifier chamber from the pressurized actuating fluid. The pressure of the fuel in the high pressure chamber abruptly drops, thereby permitting the spring to close the check against the sealing surface and terminating further fuel injection.

While the HEUI injection apparatus has been useful to control the admittance of pressurized fuel into an associated engine combustion chamber relative to approximately top dead center (TDC), such apparatus is only indirectly controlled, i.e., the motive force for moving the injector check is provided by the pressurized fuel itself rather than a directly controllable motive power source. Accordingly, the degree of controllability required to desirably reduce particulate and gaseous emissions in accordance with regulatory agency standards is minimal.

Gibson et al. U.S. patent application Ser. No. 08/172,881 discloses a fuel injector having a force-balanced check which is movable between open and closed positions by means of a low-force actuator. This fuel injector provides a high degree of controllability and is capable of use with high fuel injection pressures, thereby permitting a desirable reduction in undesirable exhaust emissions.

SAE paper 910252 by Miyaki et al. discloses a fuel injector utilizing a three-way valve to control injection by controlling the application of fluid pressure from a high pressure source to ends of a check. The injector is designed to minimize biasing forces resulting from fluid pressure differentials tending to urge the three-way valve toward either the first or second travel limit positions. This is accomplished by incorporating an inner valve slidably fitted inside an outer valve which in turn is slidably fitted inside a valve body. The clearance between the inner and outer valve and between the outer valve and the valve body provide leakage paths which are continuously subjected to the high supply pressure. For most operating conditions of the intended diesel engine application the resulting leakage exceeds the amount of fuel injected into the associated engine cylinder, thus constituting a significant reduction in the efficiency of the injection system.

DISCLOSURE OF THE INVENTION

A fuel injection system includes a HEUI fuel injector having apparatus for directly and quickly moving the check of the fuel injector using components which are simple in design, rugged and reliable.

More particularly, according to one aspect of the present invention, a fuel injection system operable to inject fuel into a combustion chamber during an engine cycle includes first pressurizing means for pressurizing a working fluid, a fuel injector coupled to the combustion chamber and means coupled to the fuel injector for supplying pressurized working fluid to the fuel injector for a time duration less than the engine cycle. The fuel injector includes second pressurizing means responsive to the pressurized working fluid supplied during the time duration for pressurizing fuel, an elongate check having first and second check ends and controlling means coupled to the second pressurizing means for controlling fluid pressure supplied to the first and second check ends during the time duration to cause the check to move to an open position and thereby inject fuel into the combustion chamber. The controlling means preferably includes only two clearance fits wherein the clearance fits are subjected to a substantial pressure differential only during the time duration.

Preferably, fuel is injected into the combustion chamber for only a portion of the time duration. Further, the fuel injector preferably includes a control valve having the two clearance fits.

Also preferably, one of the clearance fits is subjected to a substantial pressure differential during the portion of the time duration and another of the clearance fits is subjected to a substantial pressure differential during a further portion of the time duration. Still further, the first end of the check may be disposed in a bore in a stationary valve assembly to establish one of the clearance fits.

According to a particular embodiment of the present invention, the first pressurizing means comprises an oil pump. Still further, the controlling means may comprise means coupled to the second pressurizing means for delivering high pressure fuel to the second end of the check and a three-way control valve may be provided for selectively applying either of high and low pressure fuel to the first end of the check.

In accordance with a preferred form of the invention, the three-way control valve includes a stationary valve assembly having a first bore therein which receives the first end of the check, first and second sealing surfaces separated by an intermediate surface and a second bore in fluid communication between the first end of the check and the intermediate surface. A movable valve element surrounds the valve assembly and includes third and fourth sealing surfaces, a low pressure passage for coupling a source of low fluid pressure to the third sealing surface and a high pressure passage for coupling a source of high fluid pressure to the fourth sealing surface. The valve element is movable between a first position at which the third sealing surface is in sealing contact with the first sealing surface and the first end of the check is coupled to the source of high fluid pressure and a second position at which the fourth sealing surface is in sealing contact with the second sealing surface and the first end of the check is coupled to the source of low fluid pressure.

Still further in accordance with the preferred embodiment, the three-way control valve further includes an actuator operable to move the valve element between the first and second positions wherein the actuator may comprise a solid state motor, for example, of the piezoelectric type.

In addition, the delivering means may comprise a third bore in the valve assembly in fluid communication between the second pressurizing means and the second end of the check. Also, the second pressurizing means may comprise an actuable plunger and, in addition, may include a ball-type check valve coupled between the actuable plunger and the third bore.

In accordance with another aspect of the present invention, a fuel injector includes an injector body assembly, a three-way control valve having a valve element movable between first and second positions and a check disposed in the injector body assembly and movable in response to fluid pressures applied to ends thereof to inject fuel into a combustion chamber when the control valve is in the second position and to block injection of fuel into the combustion chamber when the control valve is in the first position. An actuator is selectively operable to move the valve element between the first and second positions and the injector is operable during each of a plurality of injector cycles wherein the control valve includes only a pair of clearance fits and the clearance fits are exposed to a substantial pressure differential for only a portion of each injector cycle.

In accordance with yet another aspect of the present invention, a fuel injector includes an elongate check having first and second ends and movable in response to fluid pressures applied to the first and second ends to inject fuel into a combustion chamber and means for placing the second end of the check in fluid communication with a source of high fluid pressure. A stationary valve assembly includes a first bore which receives the first end of the check, first and second sealing surfaces separated by an intermediate surface and a second bore in fluid communication between the first end of the check and the intermediate surface. A movable valve element surrounds the valve assembly and includes third and fourth sealing surfaces, a low pressure passage for coupling a source of low fluid pressure to the third sealing surface and a high pressure passage for coupling the source of high fluid pressure to the fourth sealing surface. The valve element is movable between a first position at which the third sealing surface is in sealing contact with the first sealing surface and the first end of the check is coupled to the source of high fluid pressure and a second position at which the fourth sealing surface is in sealing contact with the second sealing surface and the first end of the check is coupled to the source of low fluid pressure. A actuator is operable to move the valve element between the first and second positions.

Because the check of the fuel injector of the present invention is directly controlled, a fuel injection regime may be used which results in a reduction in undesirable emissions in the engine exhaust. Further, the fuel injector according to the present invention includes clearance type leakage paths which are subjected to high supply pressure differentials for only a small fraction of each engine cycle. Accordingly, leakage is substantially reduced.

BEST MODE FOR CARRYING OUT THE INVENTION

Figure 1:
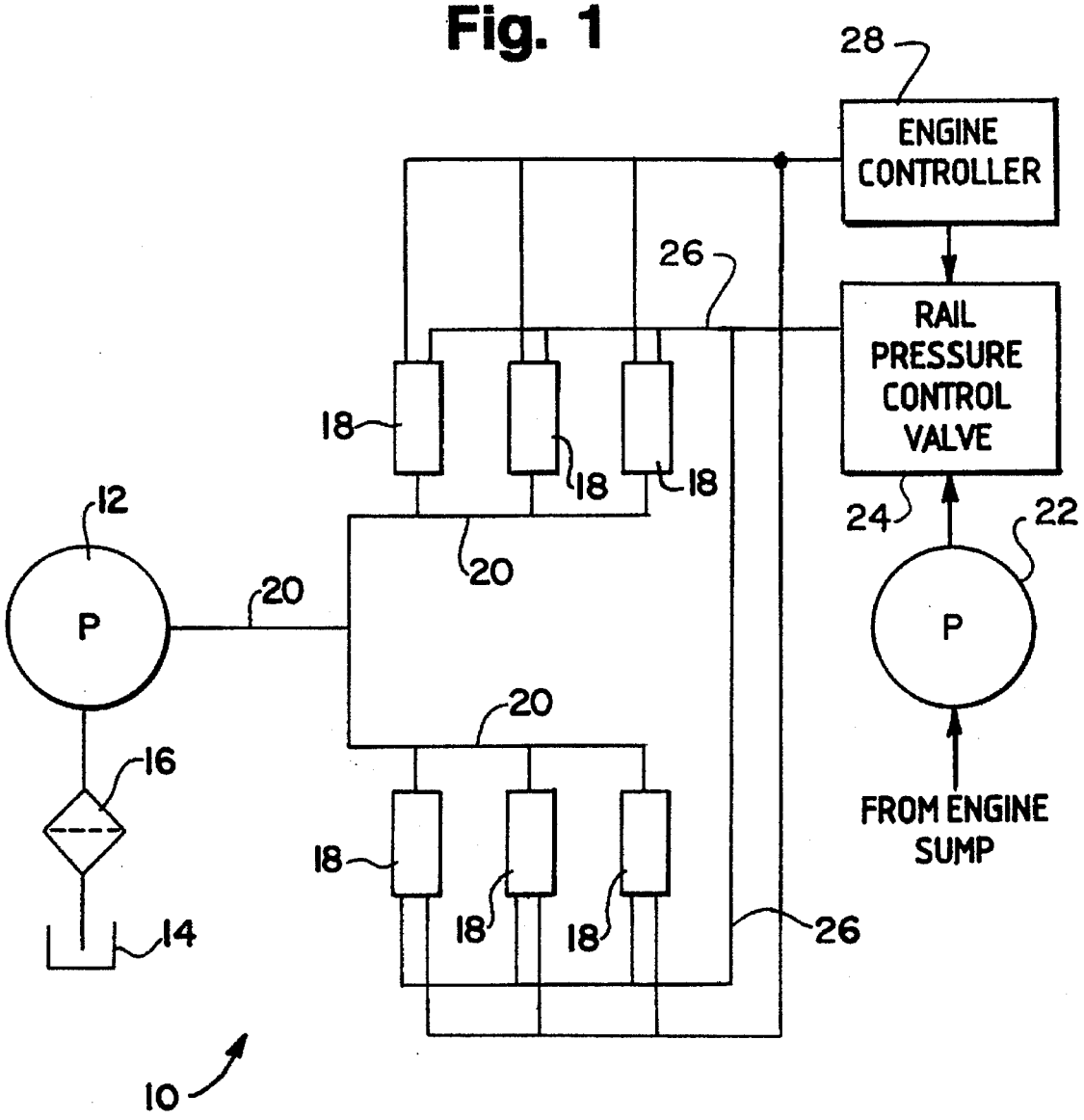
FIG. 1 comprises a combined schematic and block diagram of a common supply rail fuel injection system.

Referring now to FIG. 1, a hydraulically-actuated electronically-controlled unit injector (HEUI) system 10 includes a transfer pump 12 which receives fuel from a fuel tank 14 and a filter 16 and delivers same at a relatively low pressure of, for example, about 0.414 MPa (60 p.s.i.), to fuel injectors 18 via fuel rail lines or conduits 20. An actuating fluid, such as engine oil supplied from an engine sump, is pressurized by a pump 22 to a nominal intermediate pressure of, for example, 20.7 MPa (3,000 p.s.i.). A rail pressure control valve 24 may be provided to modulate the oil pressure provided over oil rail lines or conduits 26 to the injectors 18 in dependence upon the level of a signal supplied by an electronic engine controller 28. In response to electrical control signals developed by the engine controller 28, the fuel injectors 18 inject fuel at a high pressure of, for example, 138 MPa (20,000 p.s.i.) or greater, into associated combustion chambers or cylinders (not shown) of an internal combustion engine. While six fuel injectors 18 are shown in FIG. 1, it should be noted that a different number of fuel injectors may alternatively be used to inject fuel into a like number of associated combustion chambers. Also, the engine with which the fuel injection system 10 may be used may comprise a diesel-cycle engine, an ignition assisted engine or any other type of engine where it is necessary or desirable to inject fuel therein.

If desired, the fuel injection system 10 of FIG. 1 may be modified by the addition of separate fuel and/or oil supply lines extending between the pumps 12 and 22 and each injector 18. Alternatively, or in addition, fuel or any other fluid may be used as the actuating fluid and/or the timing and injection duration of the injectors may be controlled by mechanical or hydraulic apparatus rather than the engine controller 28, if desired.

Figure 2:
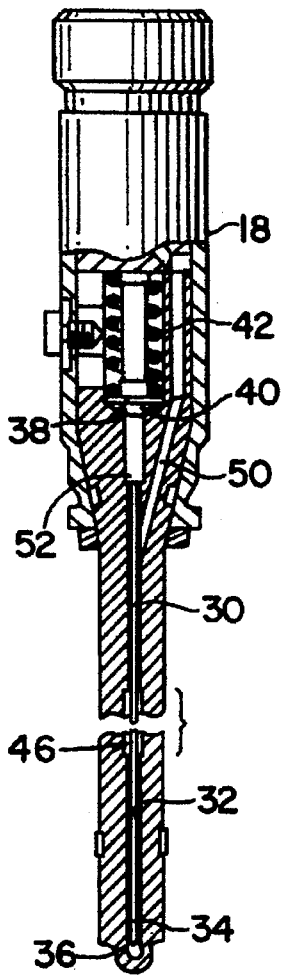
Fig. 2 PRIOR ART
FIG. 2 comprises an elevational view, partly in section, of a prior art fuel injector.

FIG. 2 illustrates a prior art fuel injector 18 which is usable with the fuel injection system 10 of FIG. 1. the fuel injector is disclosed in Glassey U.S. Pat. No. 5,191,867 and reference should be had thereto for a full description of the injector. The fuel injector 18 includes a check 30 which resides within an injector bore 32 located in an injector body 33. The check 30 includes a sealing tip 34 disposed at a first end portion 36 and an enlarged plate or head 38 disposed at a second end portion 40. A spring 42 biases the tip 34 against a valve seat 44, shown in greater detail in FIG. 3, to isolate a fuel chamber 46 from one or more nozzle orifices 48.

The fuel injector 18 further includes a fuel inlet passage 50 which is disposed in fluid communication with a fuel supply line.

Figure 3:
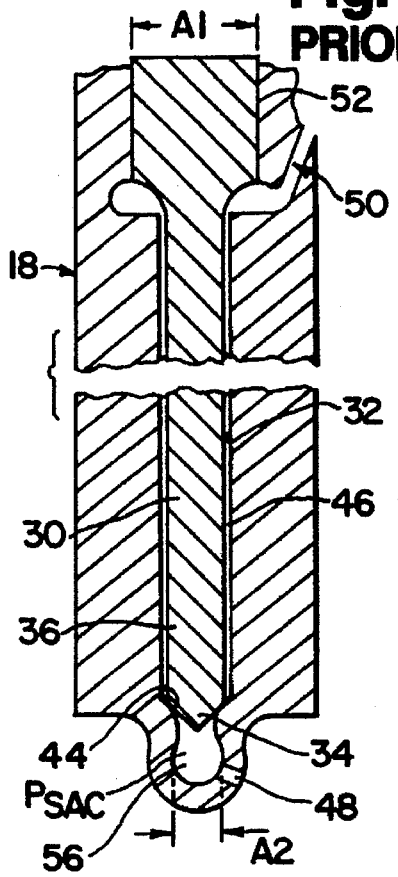
Fig. 3 PRIOR ART
FIG. 3 comprises an enlarged, fragmentary sectional view of the fuel injector of FIG. 2.
Figure 4:
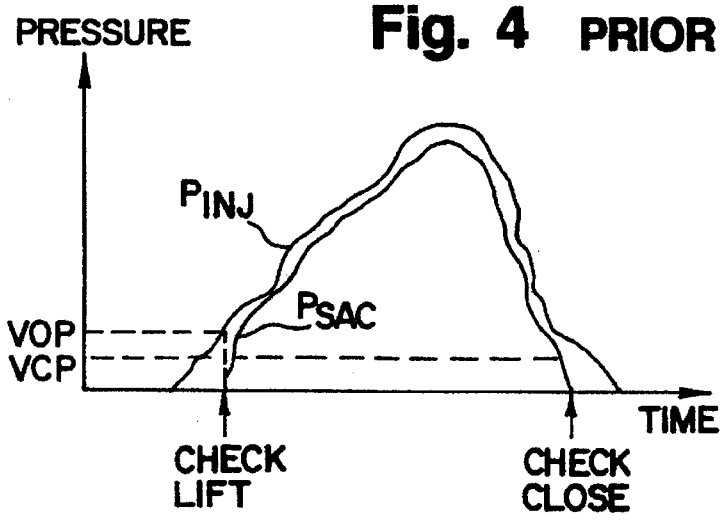
Fig. 4 PRIOR ART
FIG. 4 comprises a graph illustrating the operation of the fuel injector of FIG. 2.

As seen specifically in FIG. 3, when fuel injection into an associated cylinder is to occur, pressurized fuel is admitted through the passage 50 into the space between the check 30 and the injector bore 32 and into the chamber 46. When the pressure $P_{INJ}$ within the chamber 46 reaches a selected valve opening pressure (VOP), check lift occurs, thereby spacing the tip 34 from the valve seat 44 and permitting pressurized fuel to escape through the nozzle orifice 48 into the associated combustion chamber. The pressure VOP is defined as follows:

$$VOP = \frac{S}{A1 - A2}$$

where S is the load exerted by the spring 42, A1 is the cross-sectional dimension of a valve guide 52 of the check 30 and A2 is the diameter of the line defined by the contact of the tip 34 with the valve seat 44.

At and following the moment of check lift, the pressure $P_{SAC}$ in an injector tip chamber 56 increases and then decreases in accordance with the pressure $P_{INJ}$ in the chamber 46 until a selected valve closing pressure (VCP) is reached, at which point the check returns to the closed position. The pressure VCP is determined in accordance with the following equation:

$$VCP = \frac{S}{A1}$$

where S is the spring load exerted by the spring 42 and A1 is the cross-sectional diameter of the guide portion 52, as noted previously.

As the foregoing discussion demonstrates, opening and closing of the fuel injector 18 is accomplished only indirectly, i.e., by the force developed by the pressurized fuel admitted into the injector bore 32. One consequence of this fact is that the injector opening and closing pressures VOP and VCP are selected in advance by the overall design of the injector and cannot be readily changed. Further, in order to reduce gaseous and particulate emissions, precision metering of the fuel must be accomplished. This objective, however, is difficult to obtain using a pressure-actuated check injector such as the one described in the Glassey '867 patent.

Figure 5:
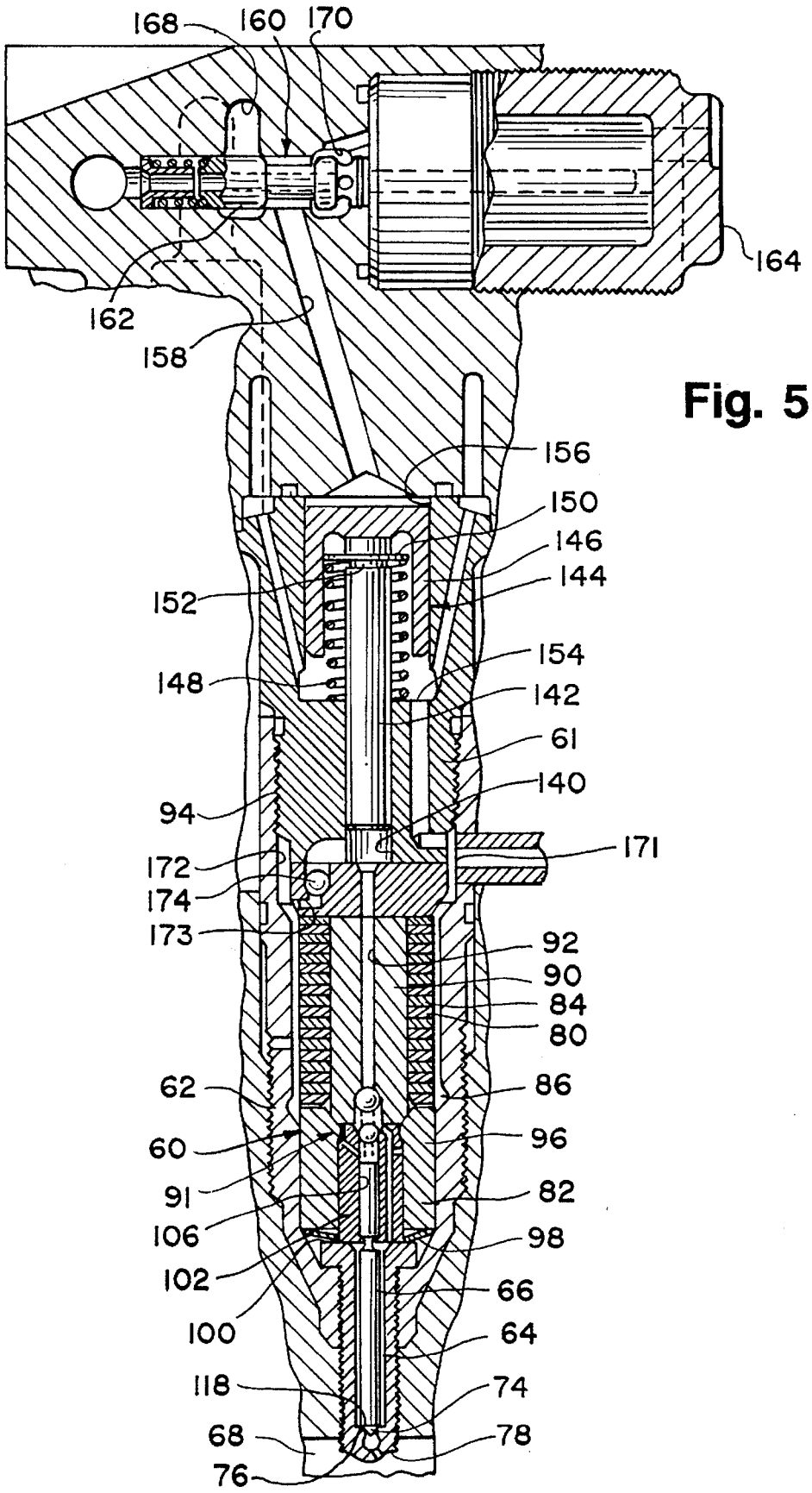
FIG. 5 comprises a full sectional view of a fuel injector according to the present invention.
Figure 6:
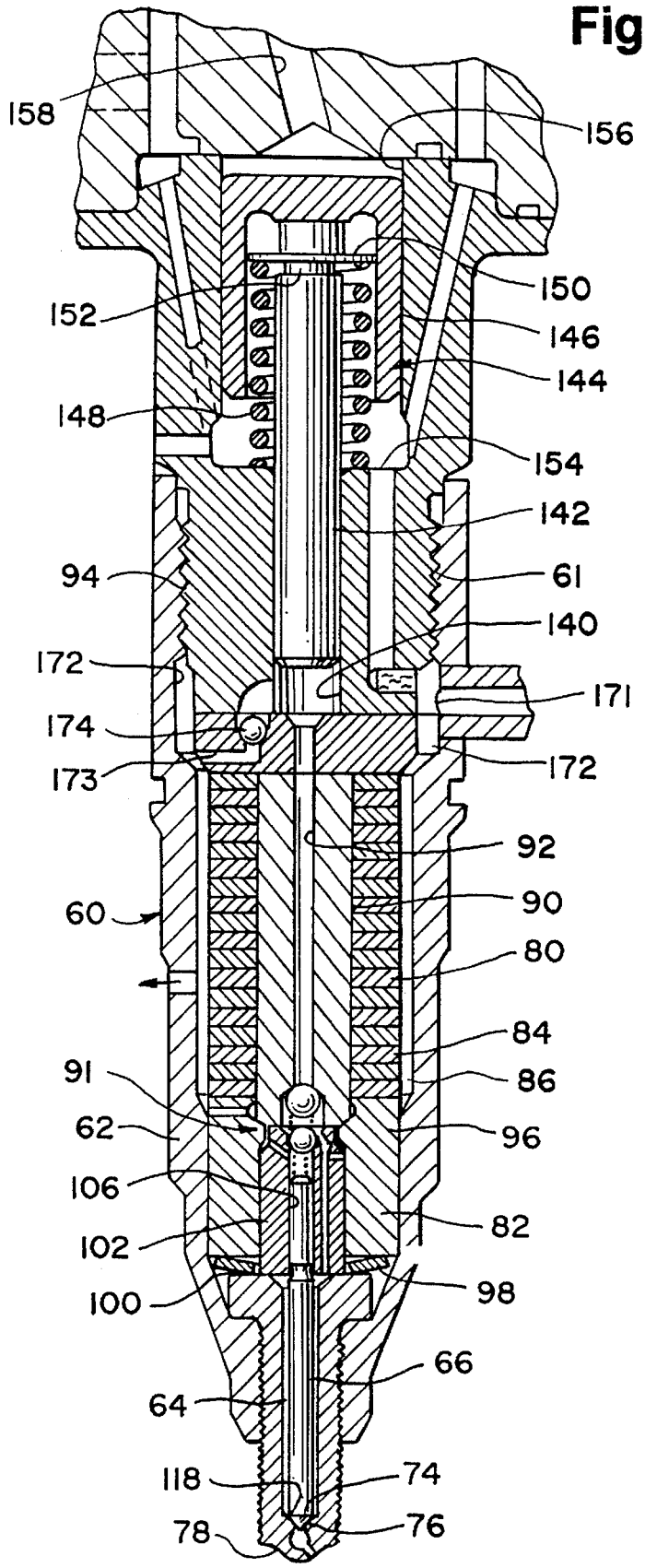
FIGS. 6 and 7 are enlarged fragmentary sectional views of the injector of FIG. 5.
Figure 7:
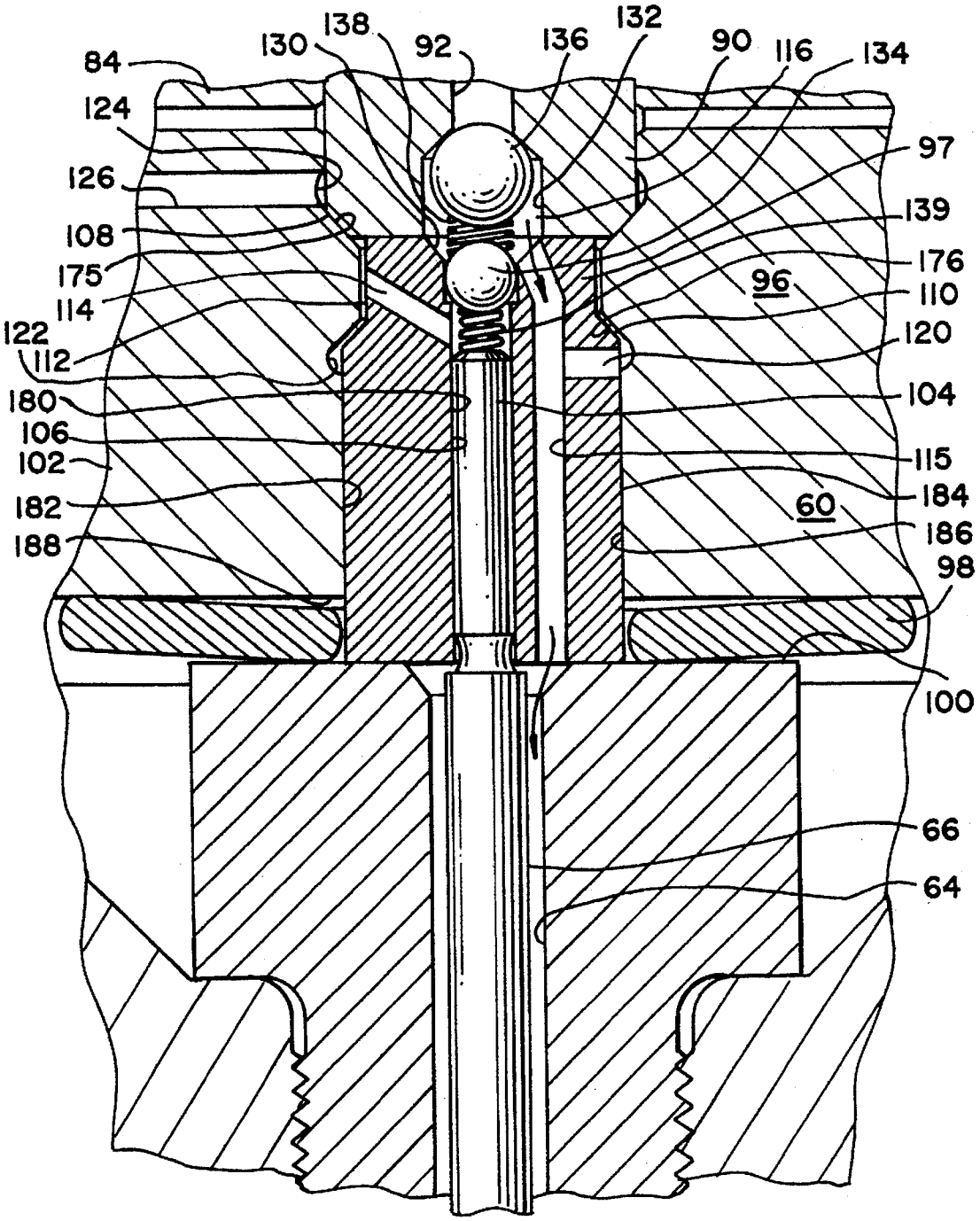

FIGS. 5–7 illustrate a fuel injector 60 according to the present invention which may be used as the fuel injector 18 in the system of FIG. 1. Alternatively, if desired, a key feature of injector 60, i.e., means for directly and quickly moving the check, may be modified in a fashion known to one skilled in the art for use in a different fuel system.

The fuel injector 60 includes an injector body assembly 61 including an injector case 62 and a cavity 64 therein. An elongate check 66 is disposed within the injector cavity 64 and is movable between a closed position at which fuel is not injected into an associated combustion chamber 68, and an open position at which fuel is injected into the combustion chamber 68. When the check is in the first position, a tip 74 of the check seals against a seat 76 in a tip 78 of the injector 60.

With specific reference to FIG. 6, the injector 60 further includes an actuator 80 coupled to a three-way control valve 82 which is in turn disposed in fluid communication with the check 66. In the preferred embodiment, the actuator 80 includes a solid state motor 84 comprising a plurality of stacked piezoelectric elements which are disposed within a recess 86. If desired, the actuator may be of a different type, for example, a solenoid. The stack of piezoelectric elements surrounds an upper barrel 90 having a fuel passage 92 therethrough. The motor 84 and the upper barrel 90 are disposed between an upper body member 94 on the one hand and a movable valve element 96 and a stationary valve assembly 97 on the other hand. The movable valve element 96 is biased to an upper or first position by a belleville washer 98 which in turn bears against an upper surface 100 of the tip 78 of the injector 60.

The movable valve element 96 surrounds a lower barrel 102 which is captured between the upper barrel 90 and the upper surface 100 of the tip 78. The lower barrel 102 comprises a part of the stationary valve assembly 97. The check 66 includes an upper or first end 104 which is disposed in close-fitting sliding relationship within a bore or passage 106 in the lower barrel 102 to form a clearance fit therebetween so that the lower barrel 102 acts as a guide for the check 66.

The stationary valve assembly 97 further includes first and second sealing surfaces or seats 108, 110 carried by the upper and lower barrels 90, 102, respectively, and an intermediate surface 112 which is carried by the lower barrel 102. A second bore or passage 114 extends between the bore 106 and the intermediate surface 112 and establishes fluid communication between the first end 104 of the check 66 and the intermediate surface 112. The lower barrel 102 further includes a third bore or passage 115 extending between a chamber 116 and the injector cavity 64 to place a second or lower end of the check 118, including the tip 74, in fluid communication with the fuel passage 92. Further, a fourth bore or passage 120 extends between the bore 115 and a high pressure annulus 122 formed in the movable valve element 96.

Also formed in the movable valve element 96 is a low pressure annulus 124 which is coupled by a bore or passage 126, an annulus 127 and an outlet port 128 (FIG. 6) to a low pressure source, such as tank.

The chamber 116 includes a first chamber portion 130 in the lower barrel 102 and a second chamber portion 132 in the upper barrel 90 opposite the first chamber portion 130. First and second ball elements 134, 136 are disposed in the first and second chamber portions 130, 132, respectively, and are urged outwardly by a spring 138 into engagement with walls defining the chamber portions 130, 132. A spring 139 is placed in compression between the ball element 134 and the upper end 104 of the check 60. As noted in greater detail hereinafter, the ball elements 134, 136 and the and the walls defining the chamber portions 130, 132 form optional check valves.

Referring again to FIGS. 5 and 6, the upper body member 94 includes a bore 140 within which is disposed a plunger 142 of an intensifier assembly 144. The intensifier assembly further includes an upper piston 146 having a hollow interior surface and a spring 148 which is located between a washer 150 carried in a groove 152 of the plunger 142 and an upper surface 154 of the upper body member 94. The piston 146 is located within a cylinder 156 which is coupled by a passage 158 to a spool valve 160. The spool valve 160 includes an axially movable spool 162 which is coupled to an armature of a solenoid 164. The spool 162 includes a reduced diameter portion 166 which is movable by the solenoid 164 to provide fluid communication between a high pressure annulus 168 which receives oil from an oil pressure source, such as the oil pump 22 and rail pressure control valve 24 of FIG. 1, and the passage 158 and which is further movable to connect a low pressure annulus 170 coupled, for example, to sump, to the passage 158.

INDUSTRIAL APPLICABILITY

Referring first to FIG. 5, for a period of time occurring once during every engine cycle (i.e., once every two complete revolutions of the engine crankshaft for a four-cycle engine or once every single complete crankshaft revolution for a two-cycle engine), the solenoid 164 is operated by a control, such as the engine controller 28 of FIG. 1, to axially move the spool 162 so that the reduced diameter portion 166 interconnects the high pressure annulus 168 with the passage 158. The pressurized oil pushes down on the top of the piston 146, thereby causing the plunger 142 to likewise move downwardly and pressurize fuel fed into the bore 140 through a fuel inlet 171, an inlet annulus 172, a passage 173 and a check valve 174. The pressure of the fuel in the bore 140 is raised to a pressure of, for example, 138 MPa (20,000 p.s.i) or greater. The pressurized fuel is delivered through the fuel passage 92 past the ball 136 into the second bore 115 and the cavity 64. The pressurized fuel is also delivered through the fourth bore 120 into the high pressure annulus 122. Preferably, this pressurization occurs during only 40 to 50 degrees of an engine cycle to provide a time duration during which injection may proceed. During all other portions of each engine cycle, (i.e., during the remaining portions of the period of time required to complete two full crankshaft revolutions in a four-stroke engine or one full crankshaft revolution in a two-cycle engine) the solenoid 164 is operated to place the reduced diameter portion 166 of the spool 162 at a position coupling the low pressure annulus 170 of the spool valve 160 to the passage 158.

During the time that the pressurized oil is supplied to the intensifier assembly 144, the solid state motor 84 may be actuated by the engine controller 28 by generation and application thereto of a drive pulse of suitable magnitude and duration. Prior to the time that the solid state motor 84 is actuated, the upper or first end 104 of the check 66 is coupled to the high pressure fuel in the high pressure annulus 122 by the second bore 114 and further is isolated from the low pressure annulus 124 by contact of a sealing surface 175 of the movable valve element 96 with the first seat 108. When the solid state motor 84 is actuated, downward pressure is applied to the movable valve element 96 to move same from the first position shown in FIG. 7, at which the intermediate surface 112 is in fluid communication with the high pressure annulus 122, to a second position wherein the intermediate surface 112 is placed in fluid communication with the low pressure annulus 124. When the movable valve element 96 moves downwardly, a sealing surface 176 is moved into sealing contact with second seat 110 and the sealing surface 174 moves out of contact with the first seat 108. The intermediate portion 112, and hence the second bore 114 and the first end 104 of the check 66, are taken out of fluid communication with the high pressure annulus 122 and placed in fluid communication with the low pressure annulus 124. Also at this time, the second or lower end 118 of the check 66 remains exposed to high pressure fuel owing to the trapping of such fuel in the passage 115 and the cavity 64, and this pressure imbalance creates a force which overcomes the force supplied by the spring 139 and displaces the check 66 upwardly, thereby permitting pressurized fuel to escape into the combustion chamber 68.

When injection of fuel is to be terminated, the signal provided to the solid state motor 84 is removed therefrom, thereby permitting the movable valve element 96 to move upwardly under the influence of the belleville washer 98 so that the sealing surface 176 moves out of contact with the seat 110 and the sealing surface 174 moves into sealing contact with seat 108. The second bore 114, and hence the first end 104 of the check 66, is thus placed in fluid communication with the high pressure annulus 122. At this time, even though the check 66 is in the open position, pressurized fuel is released from the fuel passage 92 past the ball 136 into the third and fourth bores 115, 120 and the annulus 122. As a result, the pressures applied to the first and second ends 104, 118 of the check 66 equalize and hence the fluid forces on the check 66 balance one another out. Accordingly, the check 66 moves downwardly under the influence of the spring 139 so that the tip 74 of the check 66 seals against the seat 76 in the tip 78 of the injector.

The check valve formed by the ball 134 located in the first chamber portion 130 is provided to smooth out flow disturbances that may arise during operation of the fuel injector. It should be noted that this element is optional in the sense that if such flow disturbances are not encountered, the ball 134 may simply be replaced by a wall isolating the upper end 104 of the check 66 from the second chamber portion 132. In this case, the spring 139 would be placed in compression between such wall and the check end 104.

It should further be noted that the check valve formed by the ball 136 is also optional and may be omitted, if desired.

Referring specifically to FIG. 7, the control valve 82 includes only two clearance fits, i.e., a first clearance fit 180 between the upper end 104 of the check 66 and the walls forming the bore 106 and a second clearance fit 182 between a surface 184 of the lower barrel 102 and a wall 186 of the movable valve element 96. These clearance fits are subjected to a substantial pressure differential only during the time that actuating oil is supplied under pressure to the piston 146. Specifically, during the period of time that the fuel in the fuel passage 92 is pressurized and the solid state motor 84 is not actuated, high pressure fuel is present in the high pressure annulus 122 whereas fuel pressure in a recess 188 is at a low pressure, thereby creating a substantial pressure differential across the clearance fit 182. Once the motor 84 is actuated, the pressure differential across the clearance fit 182 eventually disappears while a substantial pressure differential is developed across the clearance fit 180 owing to the relatively low fuel pressure in the second bore 114 and the high fuel pressure in the passage 115 and the cavity 64. In the preferred application of this injector, this pressurized condition is maintained only for a short period during every other revolution of the engine crankshaft, and once this pressurized condition is removed through deactuation of the solenoid 164, the pressure differentials across the clearance fits 180, 182 are removed. Accordingly, the possibility for fuel leakage is reduced, not only due to the limited amount of time the injector is pressurized, but also by the fact that only two clearance fits are present in the control valve 82.

The injector shown in FIGS. 5–7 is particularly adapted for use in the HEUI fuel injection system wherein actuating fluid, such as engine oil, is supplied as the "muscle" for pressurizing fuel and wherein an electrical signal is utilized to control the injection timing and duration. Such an arrangement permits injection pressure to be controlled independently of injection duration so that greater controllability is possible. However, as noted above, fuel pressurization may be accomplished in a different manner, for example utilizing a rocker arm or other mechanical connection to the camshaft of the engine or by other means. Also, control of the fuel injector may be accomplished by other than electrical means, for example, through the use of hydraulic or mechanical actuation schemes.

The present invention permits direct control over movement of the check and thus substantially improves fuel metering capability even at very high fuel pressures throughout the speed and load range of the engine. Accordingly, the ability to reduce emissions is improved. Also, because high pressure fuel is available for injection only during a short period of time during each engine cycle, energy savings are obtained and the potential for overfueling due to a nozzle check leak is reduced or eliminated.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A HEUI fuel injection system operable to inject fuel into a combustion chamber during an engine cycle, comprising:

first pressurizing means for pressurizing a working fluid;

a fuel injector coupled to the combustion chamber; supplying means coupled to the fuel injector for supplying pressurized working fluid to the fuel injector for a time duration less than the engine cycle;

wherein the fuel injector includes second pressurizing means responsive to the pressurized working fluid supplied during the time duration for pressurizing fuel, an elongate check having first and second check ends and controlling means coupled to the second pressurizing means for controlling fluid pressures supplied to the first and second check ends during the time duration to cause the check to move to an open position and thereby inject fuel into the combustion chamber wherein the controlling means includes a stationary valve assembly having a first bore therein which receives a first end of the check and two clearance fits and wherein the clearance fits are subjected to a substantial pressure differential only during the time duration.

2. The fuel injection system of claim 1, wherein fuel is injected into the combustion chamber for only a portion of the time duration.

3. The fuel injection system of claim 1, wherein the controlling means includes a control valve having the two clearance fits.

4. A HEUI fuel injection system operable to inject fuel into combustion chamber during an engine cycle, comprising:

first pressurizing means for pressurizing a fluid;

fuel injector coupled to the combustion chamber; and supplying means coupled to the fuel injector for supplying pressurized working fluid to the fuel injector for a time duration less than the engine cycle;

wherein the fuel injector includes second pressurizing means responsive to the pressurized working fluid supplied during the time duration for pressurizing fuel, an elongate check having first and second check ends and controlling means coupled to the second pressurizing means for controlling fluid pressures supplied to the first and second check ends during the time duration to cause the check to move to an open position and thereby inject fuel into the combustion chamber wherein the controlling means includes a control valve having two clearance fits and wherein one of the clearance fits is subjected to a substantial pressure differential during the portion of the time duration and wherein another of the clearance fits is subjected to a substantial pressure differential during a further portion of the time duration.

5. The fuel injection system of claim 3, wherein the first end of the check is disposed in a bore in a stationary valve assembly to establish one of the clearance fits.

6. The fuel injection system of claim 1, wherein the first pressurizing means comprises an oil pump.

7. The fuel injection system of claim 1, wherein the controlling means comprises means coupled to the second pressurizing means for delivering high pressure fuel to the second end of the check and a three-way control valve for selectively applying either of high and low pressure fuel to the first end of the check.

8. A HEUI fuel injection system operable to inject fuel into a combustion chamber during an engine cycle, comprising:

first pressurizing means for pressurizing a working fluid;

a fuel injector coupled to the combustion chamber; and supplying means coupled to the fuel injector for supplying pressurized working fluid to the fuel injector for a time duration less than the engine cycle;

wherein the fuel injector includes second pressurizing means responsive to the pressurized working fluid supplied during the time duration for pressurizing fuel, an elongate check having first and second check ends and controlling means coupled to the second pressurizing means for controlling fluid pressures supplied to the first and second check ends during the time duration to cause the check to move to an open position and thereby inject fuel into the combustion chamber wherein the controlling means includes two clearance fits and wherein the clearance fits are subjected to a substantial pressure differential only during the time duration; wherein the controlling means comprises means coupled to the second pressurizing means for delivering high pressure fuel to the second end of the check, and a three-way control valve for selectively applying either of high and low pressure fuel to the first end of the check; wherein the three-way control valve includes a stationary valve assembly having a first bore therein which receives the first end of the check, first and second sealing surfaces separated by an intermediate surface and a second bore in fluid communication between the first end of the check and the intermediate surface and a movable valve element surrounding the valve assembly and having third and fourth sealing surfaces, a low pressure passage for coupling a source of low fluid pressure to the third sealing surface and a high pressure passage for coupling a source of high fluid pressure to the fourth sealing surface wherein the valve element is movable between a first position at which the third sealing surface is in sealing contact with the first sealing surface and the first end of the check is coupled to the source of high fluid pressure and a second position at which the fourth sealing surface is in sealing contact with the second sealing surface and the first end of the check is coupled to the source of low fluid pressure.

9. The fuel injection system of claim 8, wherein the three-way control valve further includes an actuator operable to move the valve element between the first and second positions.

10. The fuel injection system of claim 9, wherein the actuator comprises a solid-state motor.

11. The fuel injection system of claim 10, wherein the solid-state motor is of the piezoelectric type.

12. The fuel injection system of claim 8, wherein the delivering means comprises a third bore disposed in the valve assembly in fluid communication between the second pressurizing means and the second end of the check.

13. The fuel injection system of claim 12, wherein the second pressurizing means comprises an actuable plunger.

14. The fuel injection system of claim 13, wherein the second pressurizing means further comprises a ball-type check valve coupled between the actuable plunger and the third bore.

15. A hydraulically-actuated electrically-controlled unit fuel injector, comprising an injector body assembly;

a three-way control valve having a valve element movable between first and second positions, and further having a first bore therein;

a check disposed in the injector body assembly having a first end disposed in the first bore and movable in response to fluid pressures applied to ends thereof to inject fuel into a combustion chamber when the control valve is in the second position and to block injection of fuel into the combustion chamber when the control valve is in the first position; and an actuator selectively operable to move the valve element between the first and second positions;

wherein the injector is operable during each of a plurality of injector cycles and wherein the control valve includes a pair of clearance fits and the clearance fits are exposed to a substantial pressure differential for only a portion of each injector cycle.

16. The fuel injector of claim 15, wherein the actuator comprises a solid state motor which is actuable to move a piston into engagement with the valve element.

17. A hydraulically-actuated electrically-controlled unit fuel injector, comprising an injector body assembly;

a three-way control valve having a valve element movable between first and second positions;

a check disposed in the injector body assembly and movable in response to fluid pressures applied to ends thereof to inject fuel into a combustion chamber when the control valve is in the second position and to block injection of fuel into the combustion chamber when the control valve is in the first position; and an actuator selectively operable to move the valve element between the first and second positions;

wherein the injector is operable during each of a plurality of injector cycles and wherein the control valve includes a pair of clearance fits and the clearance fits are exposed to a substantial pressure differential for only a portion of each injector cycle;

wherein the three-way control valve further includes a stationary valve assembly having a first bore therein which receives a first end of the check, first and second sealing surfaces separated by an intermediate surface and a second bore in fluid communication between the first end of the check and the intermediate surface, and wherein the valve element surrounds the valve assembly and includes third and fourth sealing surfaces, a low pressure passage for coupling a source of low fluid pressure to the third sealing surface and a high pressure passage for coupling a source of high fluid pressure to the fourth sealing surface wherein the valve element is movable between a first position at which the third sealing surface is in sealing contact with the first sealing surface and the first end of the check is coupled to the source of high fluid pressure and a second position at which the fourth sealing surface is in sealing contact with the second sealing surface and the first end of the check is coupled to the source of low fluid pressure.

18. The fuel injector of claim 17, further including means for delivering high pressure fuel to the second end of the check.

19. The fuel injection system of claim 18, wherein the delivering means comprises a third bore disposed in the valve assembly.

20. A fuel injector, comprising:

an elongate check having first and second ends and movable in response to fluid pressures applied to the first and second ends to inject fuel into a combustion chamber;

means for placing the second end of the check in fluid communication with a source of high fluid pressure;

a stationary valve assembly having a first bore therein which receives the first end of the check, first and second sealing surfaces separated by an intermediate surface and a second bore in fluid communication between the first end of the check and the intermediate surface;

a movable valve element surrounding the valve assembly and having third and fourth sealing surfaces, a low pressure passage for coupling a source of low fluid pressure to the third sealing surface and a high pressure passage for coupling the source of high fluid pressure to the fourth sealing surface wherein the valve element is movable between a first position at which the third sealing surface is in sealing contact with the first sealing surface and the first end of the check is coupled to the source of high fluid pressure and a second position at which the fourth sealing surface is in sealing contact with the second sealing surface and the first end of the check is coupled to the source of low fluid pressure; and an actuator operable to move the valve element between the first and second positions.

21. The fuel injector of claim 20, wherein the actuator comprises a selectively actuable solid-state motor.

22. The fuel injector of claim 21, wherein actuation of the solid state motor moves the valve element to the second position and wherein deactuation of the solid-state motor allows the valve element to return to the first position.

* * * * *